US005875655A

United States Patent [19]

Herman-Latack et al.

[11] Patent Number: 5,875,655

[45] Date of Patent: Mar. 2, 1999

[54] ADDITIVE DISPENSER FOR AN AUTOMATIC WASHER

[75] Inventors: Irene M. Herman-Latack, Baroda; John W. Pielemeier, St. Joseph, both of Mich.

[73] Assignee: Whirlpool Corporation, Benton Harbor, Mich.

[21] Appl. No.: 852,851

[22] Filed: May 7, 1997

Related U.S. Application Data

[60] Provisional application No. 60/020,468 Jun. 11, 1996.

[51] Int. Cl. [6] ..... D06F 39/02

[52] U.S. Cl. ..... 68/17 R; 222/166; 222/652

[58] Field of Search ..... 68/12.18, 17 R; 134/93, 99.2; 222/651, 652, 166

[56] References Cited

U.S. PATENT DOCUMENTS

| | | | |
|---|---|---|---|
| 2,927,600 | 3/1960 | Pellerin | 68/17 R X |
| 2,990,707 | 7/1961 | Gerhardt et al. | 68/17 R X |
| 3,159,016 | 12/1964 | Hertig et al. | 68/17 R |
| 4,265,100 | 5/1981 | Kretchman et al. | 68/17 R X |
| 4,323,170 | 4/1982 | Ikeda | 68/17 R X |
| 4,429,817 | 2/1984 | Ikeda | 222/652 |
| 5,469,593 | 11/1995 | Cuthbert et al. | 8/159 |

FOREIGN PATENT DOCUMENTS

| | | | |
|---|---|---|---|
| 1268576 | 5/1968 | Germany | 68/17 R |
| 60-198195 | 10/1985 | Japan | D06F 39/02 |
| 60-225595 | 11/1985 | Japan | D06F 39/02 |
| 257596 | 10/1988 | Japan | 68/17 R |
| 1330798 | 9/1973 | United Kingdom | 68/17 R |

*Primary Examiner*—Philip R. Coe

*Attorney, Agent, or Firm*—Robert O. Rice; Joel M. Van Winkle; Thomas J. Roth

[57] ABSTRACT

A wash additive dispensing system for an automatic washer wherein the wash additive dispenser system includes a cup for receiving the additive, a tray pivotally supporting the cup for movement between an upright orientation for retaining the wash additive in the cup and a dumping orientation in which the additive in the cup is dispensed. The tray is disposed along the rear portion of an access opening provided in the cabinet enclosure and is slidable supported by a housing between a first position for adding wash additive to the cup and a second position for dispensing wash additive from the cup. When disposed in the second position, a handle portion of the tray forms part of the rear surface of the washer access opening. Further, when the tray is in the second position, the cup is supported above a portion of the wash tub which includes a chute having an opening into the interior of the tub such that wash additives dispensed from the cup fall into the chute and flow into the interior of the wash tub for subsequent application onto the clothes load. An actuation system is provided for selectively rotating the cup between the upright orientation to the dumping orientation for selectively dispensing the wash additive. A water inlet hose connected to a water supply valve is supported adjacent the cup for flushing the wash additive from the cup when dispensing is desired. The wash additive system preferably consists of a plurality of cup and tray assemblies for dispensing a plurality of wash additives.

23 Claims, 4 Drawing Sheets

ADDITIVE DISPENSER FOR AN AUTOMATIC WASHER

BACKGROUND OF THE INVENTION

This application claims the benefit of U.S. Provisional application Ser. No. 60/020,468 filed on Jun. 11, 1996.

FIELD OF THE INVENTION

The present invention relates to an automatic clothes washer and more particularly, to a wash additive dispenser system for adding a predetermined amount of additive into a wash tub at a predetermined time during a wash process.

DESCRIPTION OF THE RELATED ART

During the conventional washing operation of an automatic washer, it is both desirable and necessary to add wash additives such as detergent, bleaching agents, fabric softeners, and the like, to the washer. Frequently, therefore, automatic washers are provided with dispensers for dispensing wash additives to the washing machine at predetermined times during the wash process, which generally includes a fill cycle, wash cycle, rinse cycle, and spin cycle.

Centrifugally actuated dispensers are one type of additive dispenser, and a good example of such a device is shown in U.S. Pat. No. 4,656,844, issued Apr. 14, 1987. As discussed in that patent, centrifugal dispensers typically employ a cup-like first receptacle which is usually either mounted upon the agitator or secured to the basket of the washing machine. The liquid additive contained within the first receptacle is forced upwardly and outwardly along the receptacle walls as the rotational speed of the agitator or basket increases, typically during a spin cycle, until the point is reached where the additive escapes over the edge of the first receptacle and is received into a second receptacle. When the basket slows down, the fluid works its way, under the influence of gravity, to the wash basket to contact the wash load. As can be understood, centrifugal dispensers require agitator or wash basket rotational speeds to reach a predetermined threshold speed for operation. This feature limits their usefulness. Further, centrifugal dispensers have utility primarily for vertical axis washers.

Another type of dispenser approach is electromechanical devices which require programmed remote actuation at predetermined times during the wash cycle. A good example of this type of dispenser is U.S. Pat. No. 4,323,170, issued Apr. 6, 1982. This reference discloses a wash additive dispenser system having an additive fill door on the console of the washer. A dumpable vessel is disposed below the fill door for receiving the wash additive. The fill door and dumpable vessel are interconnected such that the action of opening the fill door brings the vessel up into a horizontal position where it is held by a latch. The latch is mechanically interconnected with the machine timer such that the latch is moved to selectively release the vessel to a dispensing position. The additive is transferred from the fill door to the horizontally supported vessel upon closing the fill door, wherein the additive remains in the vessel until the vessel is released from the latch.

The dispenser configuration disclosed in U.S. Pat. No. 4,323,170, however, has many disadvantages. Specifically, in this configuration, a fill door must be provided in the console which may be objectionable from a styling viewpoint. Further, the additive must be transferred from the fill door to a vessel prior to dispensing the additive into the washing machine. This adds undesirable complexity to the system. Further, no self-cleaning means is provided for the fill door or vessel. Additionally, this type of system appears to be relatively costly to manufacture and difficult to assemble.

SUMMARY OF THE INVENTION

The invention is directed to an automatic washer having a wash additive dispensing system wherein the wash additive dispenser system includes a cup for receiving and dispensing the additive, a tray pivotally supporting the cup for movement between an upright orientation for retaining the wash additive in the cup and a dumping orientation in which the additive in the cup is dispensed. The tray is disposed along the rear portion of an access opening provided in the cabinet enclosure and is slidable between a first position for adding wash additive to the cup and a second position for dispensing wash additive from the cup. When disposed in the second position, a handle portion of the tray forms part of the rear surface of the washer access opening. Further, when the tray is in the second position, the cup is supported above a portion of the wash tub which includes a chute having an opening into the interior of the tub such that wash additives dispensed from the cup fall into the chute and flow into the interior of the wash tub for subsequent application onto the clothes load.

An actuation system is provided for selectively rotating the cup between the upright orientation to the dumping orientation for selectively dispensing the wash additive. The actuation system includes a lever positioned adjacent to the cup when the tray is in the second position and means for selectively actuating the lever to rotate the cup from the upright orientation to the dumping orientation. A water inlet hose, connected to a water supply valve, is supported adjacent to the cup for supplying water to the cup for flushing the wash additive from the cup when dispensing is desired.

DESCRIPTION OF PREFERRED EMBODIMENTS

Figure 1:
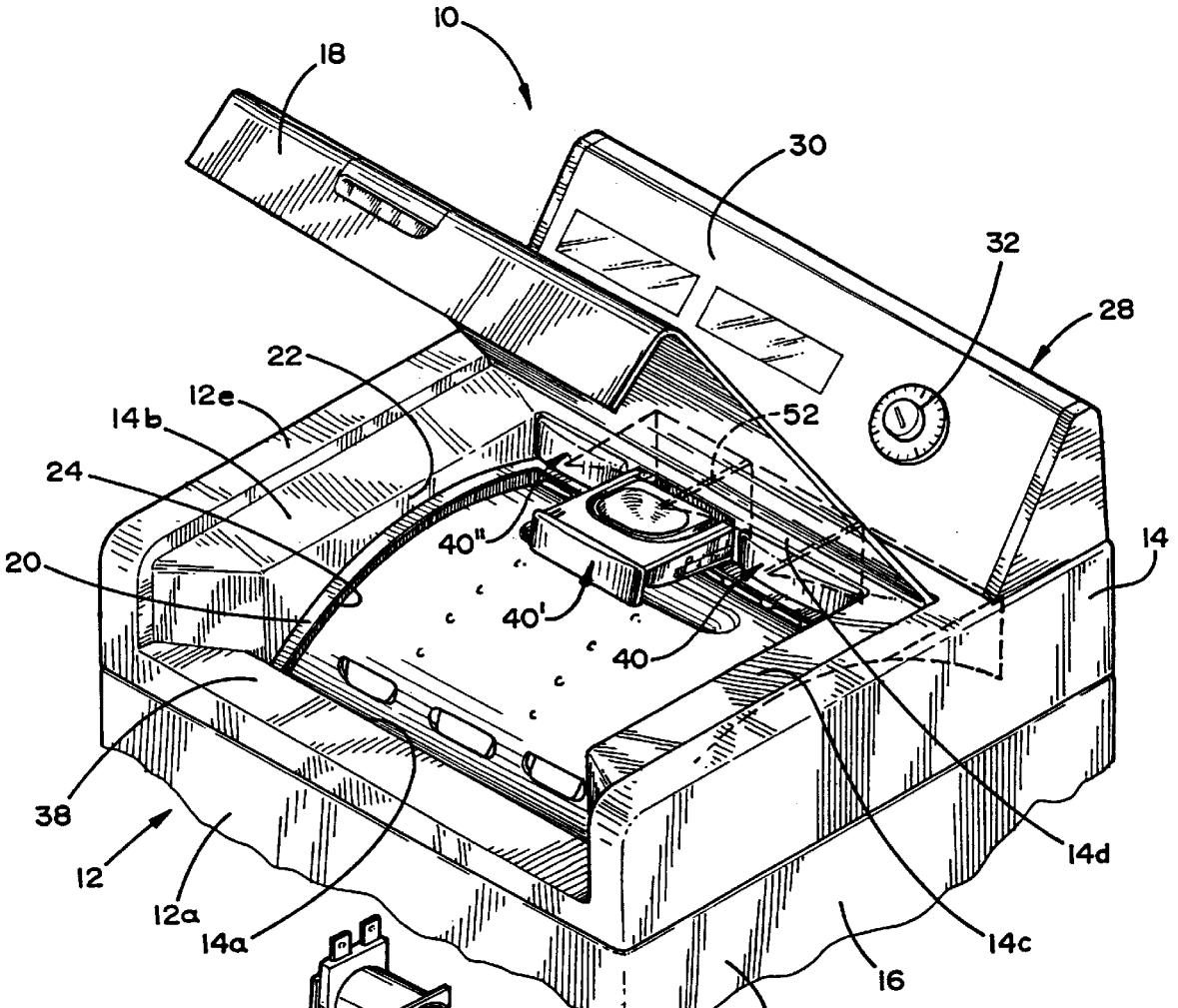
FIG. 1 is a partial perspective view of the upper portion of the automatic washer embodying the present invention having a lid shown in the open position.
Figure 3:
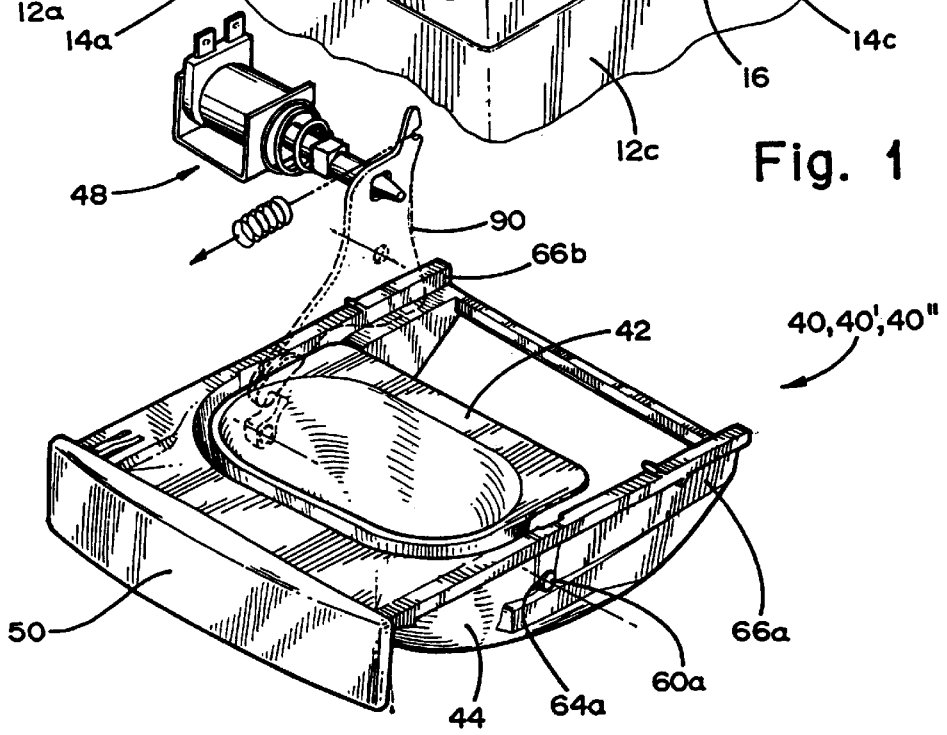
FIG. 3 is a perspective view of a dispensing cup of the wash additive dispenser of the present invention.
Figure 2:
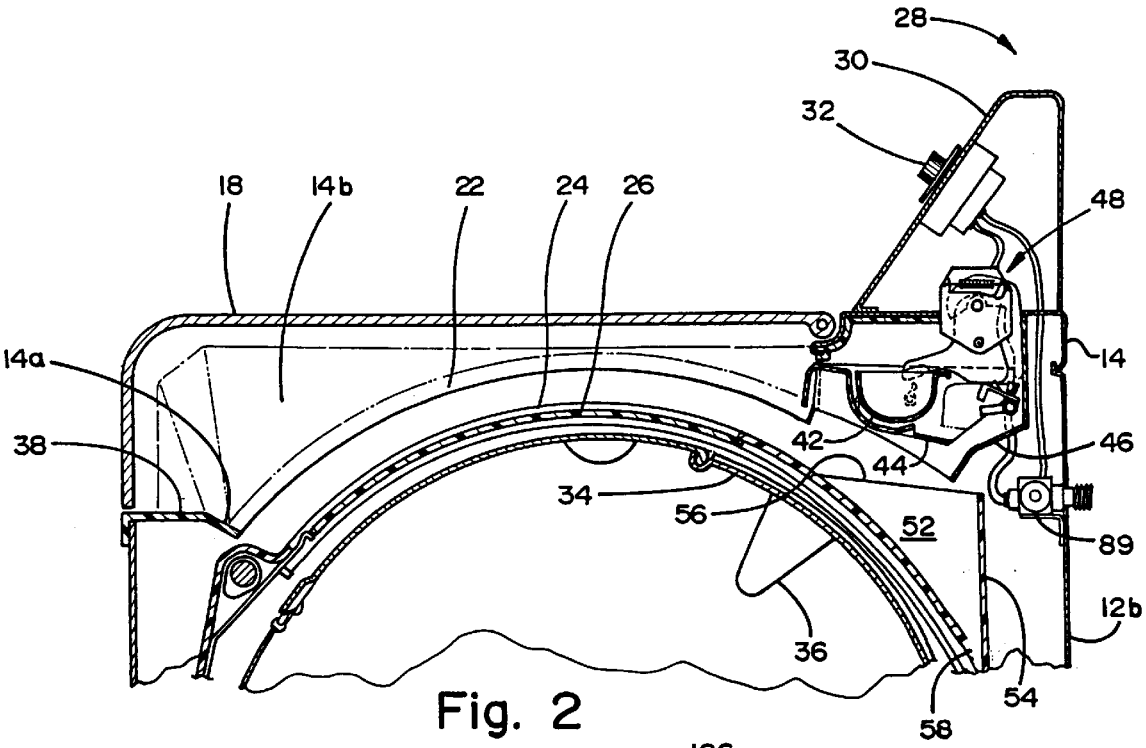
FIG. 2 is a partially cut away side elevational view of the automatic washer of FIG. 1 with the lid in the closed position.

In FIGS. 1 and 2 there is illustrated a toproading drum-type automatic washer 10 embodying the principles of the present invention. Although a horizontal axis washer is shown as the preferred embodiment, the present invention is not limited to a horizontal axis washer and, in fact, could be readily adapted to a vertical axis washer. The washer 10 has an enclosure 12 generally defining a front surface 12*a*, a back surface 12*b*, opposite side surfaces 12*c* and 12*d* and a top surface 12*e*. The enclosure includes a top member 14, an outer cabinet 16 and an openable lid 18, shown in an open position, which encloses an imperforate wash tub 20. The top member 14 includes an access opening 22 extending partially along the top surface 12*e* and the front surface 12*a* for accessing the interior of the enclosure 12. The wash tub 20 has an upwardly orientated rectangular tub opening 24. The opening 24 is aligned with the access opening 22. A slidable wash tub lid 26, shown in an open position in FIG. 1, is provided for sealably closing the opening 24.

A console 28 having a control panel 30 is provided extending from a rear portion of the top member 14. Controls 32 are mounted on the control panel 30 for receiving input from the operator and for selectively controlling the operation of the washer 10.

Disposed within the wash tub 20 is a rotatable, perforate wash basket 34 having openable door flaps 35*a*, 35*b*. The door flaps may be aligned with the tub opening 24 for allowing access into the wash basket 34 such that clothes may be loaded and unloaded from the wash basket 34. A plurality of baffles 36 (FIG. 2) may be disposed within the basket 34, attached to the inner surface of the basket 34 and extending inwardly for enhancing the tumbling action of the clothes items during a wash cycle. The construction of the rotatable basket 34 is further shown and described in U.S. patent application Ser. No. 07/997,435, Farrington et al., now U.S. Pat. No. 5,345,792, and U.S. patent application Ser. No. 08/236,822, Cuthbert, et al., now U.S. Pat. No. 5,469,593, the specifications of which are herein incorporated by reference.

Although not shown, the washer 10 further includes a suspension system for supporting the tub 20 and a motor drivably connected with the basket 34 such that the motor may rotate the basket 34 within the tub 20, as is well known.

The automatic washer 10 is configured to ease loading and unloading of clothes items into the wash basket 34. As described above, the access opening 22 is configured to extend partially along the top surface 12*e* and front surface 12*a* such that clothes items being loaded and unloaded from the wash basket 34 need only be raised to the height of a front lip portion 38 of the top member 14 to pass through the access opening 22. The top member 14 includes a front edge 14*a*, downwardly sloped side surfaces 14*b* and 14*c*, and a rear surface 14*d*, all of which combine to define the access opening 22. The side surfaces 14*b* and 14*c* extend from the top surface 12*e* to the edge of the access opening 22 for providing a funneling effect such that clothes being loaded into the wash basket 34 are downwardly directed under the urgings of gravity along the side surfaces 14*b* and 14*c* into the wash basket 34.

According to the present invention, a plurality of wash additive dispensers 40, 40' and 40" are disposed along the rear surface of the top member 14. Each dispenser includes a cup 42 for receiving a wash additive, a tray 44 pivotally supporting the cup 42, a housing 46 slidably supporting the tray 44, and an actuation system 48 for selectively rotating the cup 42 within the tray 44 for dispensing the wash additive. The cup has a lip 42*a* on at least its rear edge.

Each tray 44 is slidably supported by the housing 46 to be movable between a first or loading position (dispenser 40' of FIG. 1) and a second or dispensing position (40 and 40" of FIG. 1). When disposed in the second position, a front portion 50 of the tray 44 aligns with the rear surface 14*d* of the top member 14. In this fashion, the front portion 50 forms a part of the access opening 22. The front portion 50 further serves as a handle for moving the tray 44 from the dispensing position to the loading position and back again. The front portion is clearly visible and readily accessible to the operator when the lid 18 is in an open position and may be conveniently provided with graphics for indicating the specific type of wash additive for each dispenser. For example, one dispenser may be for bleach, one for detergent, and one for fabric softener.

When the tray 44 is in the loading position, the tray 44 is oriented forward, extending into the access opening 22 such that the cup 42 is accessible for receiving a charge of wash additive. In this position, the cup 42 is supported by the tray 44 in an upright orientation.

When the tray 44 is moved from the loading position back into the dispensing position, the cup 42 is rotatably supported beneath the console 28 of the washer above the tub 20. The portion of the tub 20 which is disposed directly below the cup 42 includes multiple chutes 52, corresponding to each of the dispensers 40, 40', and 40", formed from a back wall 54 and multiple divider walls 56, which extend upwardly from the tub 20. Each chute 52 includes an opening 58 for accessing the interior of the tub 20, wherein the openings 58 are disposed at the lowest portion of the chutes 52; i.e., at the tangential intersection of the back wall 54 and the tub 20. When dispensing of the wash additive from the cup 42 is desired, the actuation system 48 causes the cup 42 to rotate from the upright orientation to a dumping orientation such that the wash additive flows from the cup 42 into the corresponding chute 52 and into the bottom tub 20 therefrom without contacting basket 34.

Turning now to FIGS. 3, 4, 5 and 6, the details of the dispenser 40 are further illustrated. As contemplated by the inventors, each of the dispensers 40, 40' and 40" are substantially similar and operate in a like fashion such that a description of the dispenser 40 teaches the structure of the dispensers 40' and 40".

The cup 42 includes pins 60*a*, 60*b* extending outwardly and located at opposite ends of the cup 42. The pins 60*a* and 60*b* are rotatably received into holes 64*a* and 64*b* formed into opposite side portions 66*a*, 66*b* of the tray 44. The pins 60*a* and 60*b* are placed in an off-center-position such that cup 42, when rotatably supported by the tray 44, is biased under the urgings of gravity to rotate in a counter-clockwise direction, as indicated by arrow 68. Stop surfaces 70*a* and 70*b*, on the cup 42 and tray 44, respectively, cooperate to interfere with the counter-clockwise rotation of the cup 42 such that the cup 42 is normally supported in the upright position for retaining a charge of wash additive. The cup 42 further includes a cam 71 extending outwardly from the cup 42.

The housing 46 is preferably formed from a thermoplastic resin and includes a top portion 72 mounted to a lower surface of the top member 14. A pair of tray support walls 76 and 78 are provided for each tray 44. The support walls 76 and 78 extend downwardly from the top portion 72. The support walls each include a slot 80 and 82, respectively, which slidingly receive flange portions 84 and 86 of the tray 44 such that the tray 44 is slidingly supported by the housing 46. The housing 46 further supports a header 88 comprising an elongated tube connected to a water supply valve 89 (FIG. 2) for supplying water to the wash tub 20. The header 88 has multiple sets of forwardly directed outlet openings, 88*a* and rearwardly directed outlet openings 88*b*. As contemplated by the inventor, the dispenser designated for dispensing chlorine bleach does not require flushing with water since chlorine bleach is typically liquid and is naturally self-cleaning.

Figure 4:
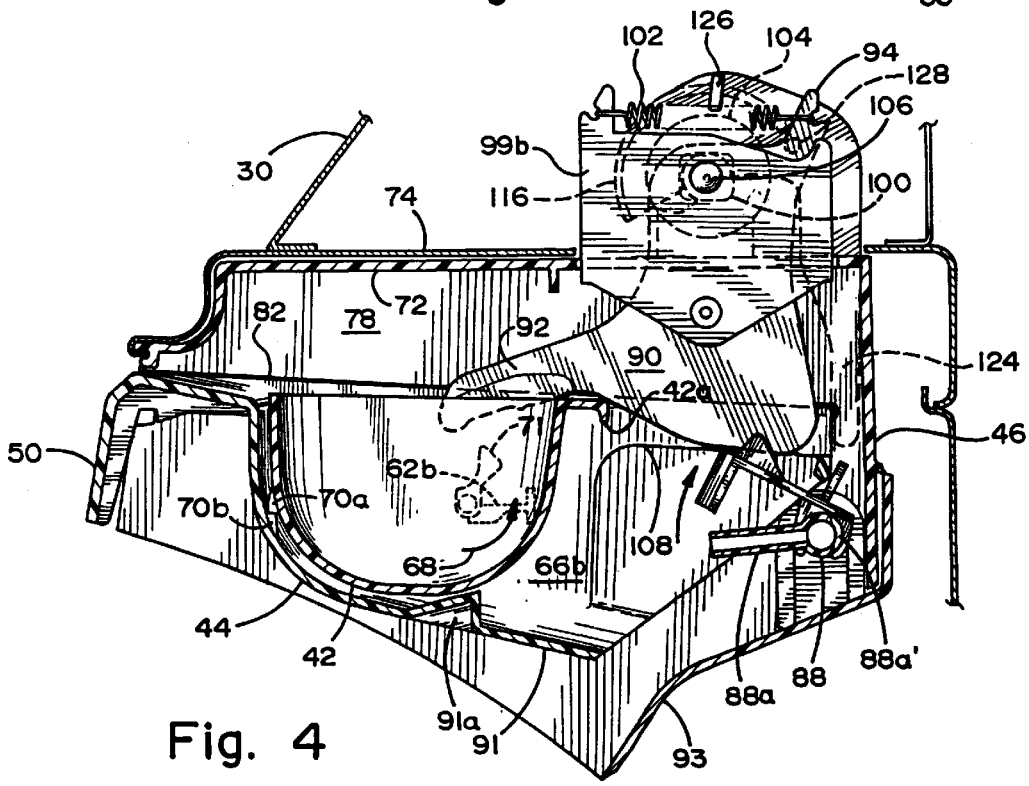
FIG. 4 is an enlarged sectional view of the dispenser of the present invention showing the dispensing cup in an upright orientation.
Figure 5:
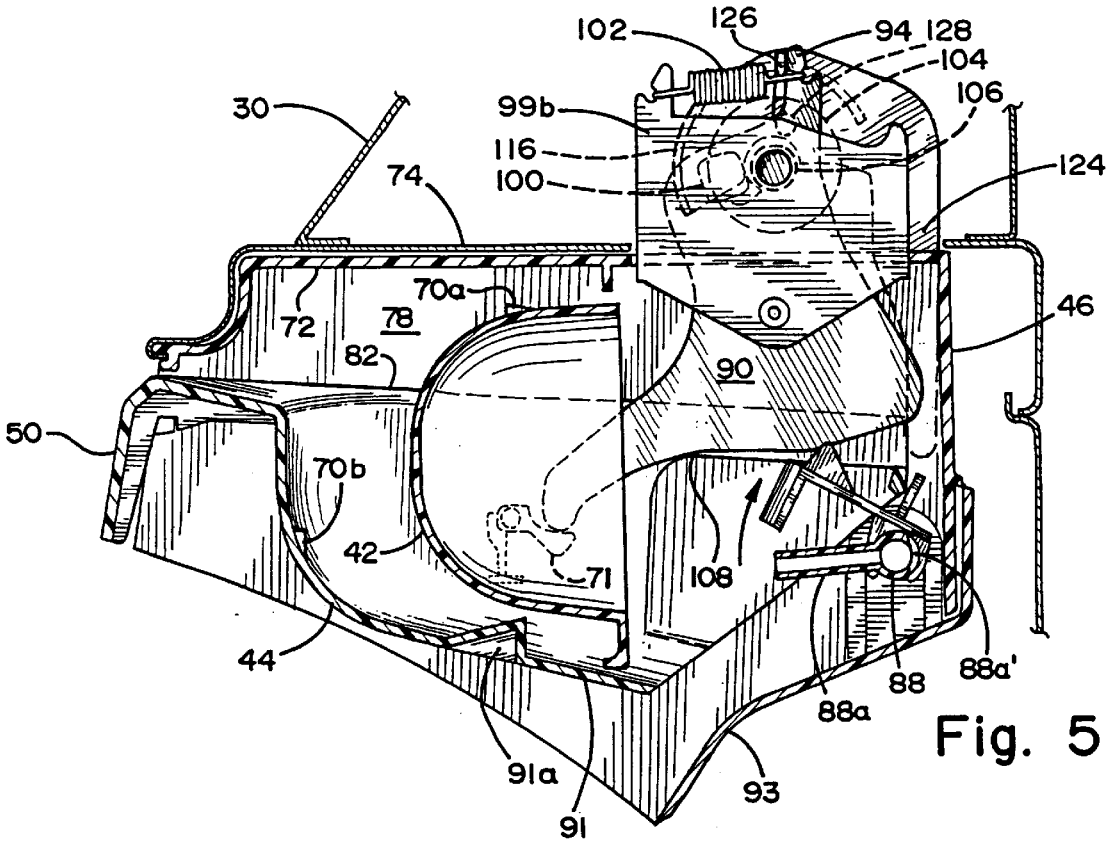
FIG. 5 is an enlarged sectional view of the dispenser of the present invention showing the dispensing cup in a dumping orientation.

As shown in FIG. 4, when the supply valve 89 is energized and the cup 42 is in the upright orientation, water flows from the outlet opening 88*a* against the exterior surface of the cup 42 and from there into the tub 20 through the chute 52. The lip 42*a* of the cup 42 prevents the water from flowing into the cup 42 and diluting or overflowing the additive. A downwardly extending bottom tray wall 91 and a downwardly extending rear housing wall 93 cooperate to direct the water flowing from the outlet opening 88*a* into the chute 52 and subsequently into the sump of the wash tub 20. The bottom tray wall 91 has multiple spaced dams 91*a*, which substantially prevent water from flowing under the cup 42 and possibly diluting or overflowing the additive prior to dispensing. It should be understood that the tray 44 and housing 46 provide an enclosure such that water exiting from the outlet opening 88 is directed into the tub 20. For example, as shown in FIG. 5, when the cup 42 is in the dumping orientation, the flow of water from outlet opening 88*a* flushes the interior of the cup 42. Also, the water from the outlet opening 88*b* washes the rear housing wall 93. Again, the bottom tray wall 91 and the rear housing wall 93 cooperate to direct the water flowing from the header 88 into the chute 52 and subsequently into the sump of the wash tub 20.

The actuation system 48 includes a drive arm 90 pivotally supported by the housing 46. The drive arm 90 includes a first elongated portion 92, extending toward the cam of the cup 42, and a second portion 94 which extends through a slot 96 provided in the housing 46 and a corresponding slot 98 provided in the top panel 14. Guidewalls 99*a* and 99*b* extend upwardly from the housing 46 adjacent the drive arm 90. An aperture 100 is provided on the second portion 94 of the drive arm 90. The drive arm 90 is biased by a spring 102, interconnected with one of the guidewalls and the second portion 94 of the drive arm 90, such that the first elongated portion 92 of the drive arm 90 is biased to rotate in a counter-clockwise direction as viewed in FIG. 4.

A solenoid 104 is positioned adjacent the second portion 94 and includes a retention pin 106 which is biased by spring 108 toward the second portion 94 for engagement with the aperture 100. Energization of the solenoid 104 moves the retention pin 106 longitudinally relative to the solenoid 104 to selectively disengage the pin 106 from the aperture 100 provided in the drive arm 90.

The solenoid 104 is mounted to the top 14 by a solenoid bracket 110, having a longitudinally extended base 112, which terminates at one end in the guidewall 99*a* and at the other end in multiple spring clips 114 in which the solenoid 104 is snap-fitted. A solenoid cover 116 is snap-fit to the solenoid by a clip 118, which permits rotation of the solenoid cover 116 with respect to the solenoid 104. The solenoid cover 116 shields the spring 108 and pin 106 from possible entanglement with console wiring and eliminates need for positive ground. A spring 120 extends between a slot 122 and the solenoid cover to the base 112 and biases the solenoid cover 116 to rotate in a counter-clockwise direction as seen in FIG. 4.

A stop arm 124 extends downwardly from the end of the solenoid cover 116 adjacent to the support wall 78. The stop arm 124 is of sufficient length so that the terminal end of the stop arm lies in the path of the flange 86 of the tray 44. The solenoid cover 116 further has a stop tab 126, which abuts a stop pin 128 on the drive arm 90 when the solenoid cover 116 is rotated counter-clockwise to its farthest extent by the spring 120. This occurs only when the tray 44 is in the open position or completely removed from the housing 46.

During operation, the tray 44 may be manually moved into the loading position by pulling on the front portion 50 of the tray 44. As the tray is pulled out (moved to the loading position), the stop arm 124, which abuts the end of the tray flange 86, is rotated clockwise by the spring 120, and the stop tab 126 abuts the pin 128, preventing the rotation of the drive arm 90. Thus, when the tray is in the loading position, the drive arm 90 cannot rotate to prevent returning the tray to the dispensing position. Although it is not shown, it is contemplated that a deflector be positioned in front of the outlet opening to deflect the water downward into the chute if the tray is in the loading position or totally removed from the housing.

The operator may then load the cup 42 with a charge of wash additive and push the tray 44 back into the dispensing position, which rotates counter-clockwise the stop arm to move the stop tab out of the path of the pin to permit the rotation of drive arm. The cup 42 remains in the upright orientation until dispensing of the wash additive is desired. At such time, the solenoid 104 is energized so that the retention pin 106 is selectively pulled out of engagement with the aperture 100. Once the retention pin 106 disengages from the aperture 100, the drive arm 90 rotates under the urging of the tension spring 102 wherein the first elongated portion 92 of the drive arm 90 engages the cam 71 to rotate the cup 42 clockwise from the upright orientation, shown in FIG. 4., to the dumping orientation, shown in FIG. 5. In the dumping orientation, the wash additive readily flows from the cup 42 into the corresponding chute 52.

At the same time that the solenoid 104 is energized, the supply valve 89 may be energized such that water flows through the header 88 into the cup 42 and the outlet opening 88*b* against the rear wall 93 where the cup 42 is swept clean of all wash additives and the water and the wash additives flow through the chute 52 into the tub 20. In this fashion, the dispenser apparatus 40 is self-cleaning. Further, the dispenser apparatus 40 provides for mixing of the wash additive with inlet water prior to application onto the clothes load disposed in the basket 34.

The cup 42 remains in the dumping orientation until the tray 44 is manually moved from the dispensing position to the loading position, preceding a subsequent wash cycle. During the sliding movement of the tray 44 from the dispensing position to the loading position, the first elongated portion 92 of the drive arm 90 engages a ramp 108 provided on the tray 44. The ramp 108 acts to drive the first elongated portion 92 upward such that the drive arm 90 rotates clockwise until the retention pin 106 engages the aperture 100 such that the drive arm 90 is held until the solenoid 104 is energized wherein the drive arm 90 is released to rotate toward the cam 71, as described above.

Figure 7:
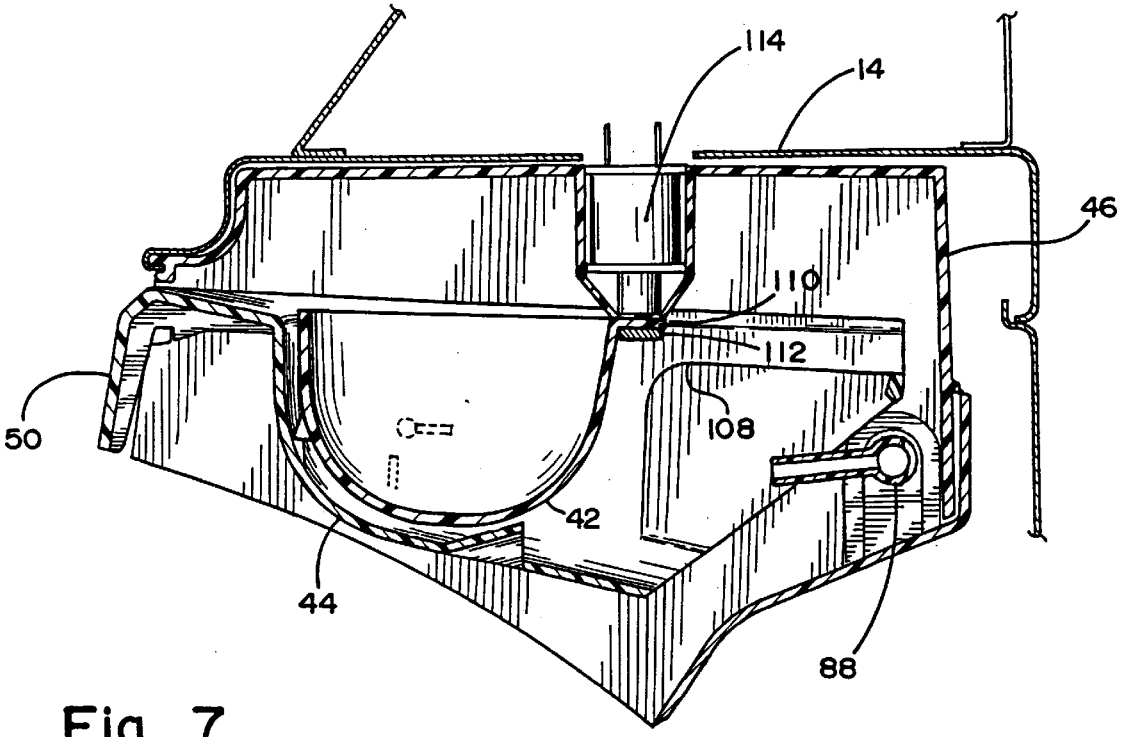
Figure 6:
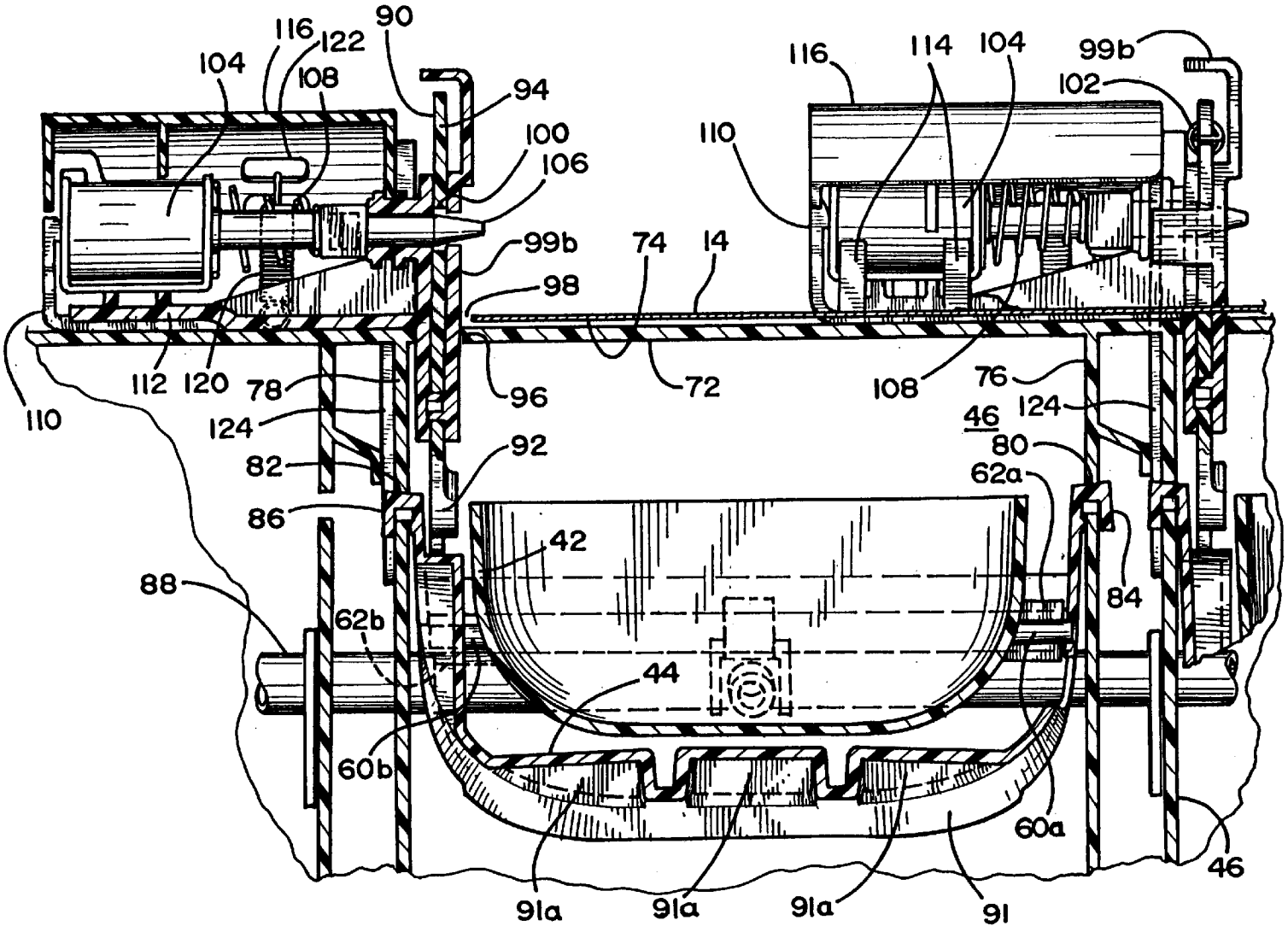
FIG. 6 is a sectional view taken along lines 6—6 in FIG. 4; and, FIG. 7 is an alternative embodiment of the actuation system of the present invention.

FIG. 7 illustrates an alternative actuation system for the present invention where like reference characters designate identical or corresponding elements of the above-mentioned first embodiment.

In this system, the cup 42 is pivotally supported in an unstable condition such that the cup is urged to rotate toward the dumping position under the influence of gravity. The cup 42 includes a lip portion 110 having a magnetic element 112 affixed thereto. An electromagnet 114 is provided, supported by the top panel 14, for selectively repelling the magnetic element 112 such that the cup 42 may be actuated to rotate to the dumping orientation. During operation, the cup 42 is loaded with a charge of additive. When the tray 44 is pushed into the dispensing position, the magnetic element's attraction to the body of the electromagnet 114 maintains the cup in the upright orientation. When dispensing of the additive is desired, the electromagnet 114 is energized, creating a magnetic field which repels the magnetic element 112, thereby releasing the cup 42 to rotate to the dumping orientation.

It can be seen, therefore, that the present invention provides a simple and economical system for dispensing wash additives into a wash tub of an automatic washer. In the present invention, dispenser cups are conveniently located in slidable trays at the rear portion of the cabinet enclosure access opening. The present wash additive dispensing system is self-cleaning and automatically actuated. Further, the wash additives are dispensing in such a fashion that mixing with water occurs prior to the application of the additives onto the clothes load.

Although the present invention has been described with reference to a specific embodiment, those of skill in the Art will recognize that changes may be made thereto without departing from the scope and spirit of the invention as set forth in the appended claims. For example, it can be understood by one skill in the Art that at least one cup of such a dispensing system may be actuated by a mechanical linkage provided between a timer cam and one of the cups. Specifically, the inventors have contemplated that a bleach dispenser may utilize such an actuation system rather than the above-described solenoid-driven actuation system.

Another example of a minor change in the present invention which would fall within the scope of the appended claims is to the lever. As described above, the lever 90 is rotatable about a pivot point. However, one of skill in the Art can readily understand that a linearly-moving lever arm may be configured to function in the same manner. Further, the ramp 108 may be replaced by any number of structures which would operate to engage the lever 90 such that the lever 90 is disengaged form the cup 42. For example, the ramp 108 may be replaced by a boss or a rib.

It an also be understood by one skilled in the Art that various actuation systems for rotating the dispensing cups of the present invention may be provided which depart from the specific description of the preferred embodiment but which come within the scope of the appended claims. For example, the inventors have contemplated an actuation system wherein the cup is pivotally supported by the tray for normally rotating toward the dumping orientation and wherein the drive arm serves to support the cup in the upright orientation until dispensing of the wash additive is desired. It can be further understood that the spring 102 may be replaced with any number of alternative biasing means. For example, a torsion spring could be employed about the pivot point of the drive arm 90.

It should be understood, therefore, that we wish to embody within the scope of the patent warranted hereon all such modifications as reasonably and properly come within the scope of our contribution to the Art.

We claim:

1. In an automatic washer having a tub for receiving a clothes load to be washed and a water supply for delivering water to said tub, a dispenser system for delivering a wash additive to said tub, said dispenser system comprising:

a cup for receiving said wash additive;

a tray pivotally supporting said cup for movement between an upright orientation for holding said wash additive in said cup and a dumping orientation in which said wash additive is dispensed from said cup, said tray being slidable between a first position for adding said wash additive to said cup and a second position for dispensing said wash additive from said cup;

a lever positioned adjacent said cup when said tray is in said second position, and means for selectively actuating said lever to engage said cup for moving said cup from said upright orientation to said dumping orientation.

2. The dispenser system according to claim 1 further wherein:

said cup is pivotally supported by said tray in said second position such that said cup is urged by gravity to be oriented in said upright orientation; and said lever selectively engages said cup such that said cup is urged by said lever to rotate toward said dumping orientation.

3. The dispenser system according to claim 1 further wherein:

said cup is pivotally supported by said tray in said second position such that said cup is urged by gravity to rotate toward said dumping orientation; and said lever supports said cup in said second position in said upright orientation and is selectively actuatable to release said cup to rotate toward said dumping orientation.

4. The dispenser system according to claim 1, further comprising:

a lever positioned adjacent said cup when said tray is in said second position;

a spring interconnected with said lever for biasing said lever toward said cup; and, means for selectively releasing said lever to move toward said cup such that said lever engages said cup and moves said cup from said upright orientation to said dumping orientation.

5. The dispenser system according to claim 4, further comprising:

means for engaging said lever such that said lever disengages said cup such that said cup returns to said upright position from said dumping position.

6. The dispenser system according to claim 1, further comprising:

means for directing said water supply into said cup when said cup is in said dumping orientation such that said wash additive is flushed from said cup.

7. The dispenser system according to claim 1, further comprising:

a housing for slidably supporting said tray in said first and second positions;

an inlet hose interconnected with said water supply, said inlet hose being supported by said housing adjacent said cup wherein water flowing from said inlet hose flushes said wash additive from said cup when said cup is in said dumping orientation.

8. The dispenser system according to claim 1, wherein the automatic washer further includes an enclosure surrounding said tub, said enclosure having an access opening aligned with an opening in said tub, the dispenser system further wherein:

said tray has a handle portion, said tray is further slidably disposed adjacent said access opening such that when said tray is disposed in said first position, said cup is accessibly disposed within said access opening and when said tray is in said second position, said handle forms a portion of said access opening.

9. The dispenser system according to claim 1, wherein said tub includes a sump portion for receiving water supplied to said tub, said dispenser system further comprising:

a chute disposed below said cup when said cup is supported in said second position, said chute extending from said tub for directing said dispensed wash additive to said tub sump without contact with clothes load.

10. The dispenser system according to claim 1, wherein the automatic washer further includes an enclosure surrounding said tub, said enclosure having an access opening aligned with an opening in said tub, the dispenser system further comprising:

a plurality of cups for receiving and dispensing said wash additive;

a plurality of trays, corresponding in number to said cups, for pivotally supporting said cups for movement between said upright orientation and said dumping orientation, said trays being slidable between a first position for adding said wash additive to said cups and a second position for dispensing said wash additive from said cups, each of said trays having a handle portion wherein said trays are sidably disposed adjacent said access opening such that when said trays are disposed in said first position, said cup is accessibly disposed within said access opening and when said trays are in said second position, said handle portions form a portion of said access opening;

a plurality of means for selectively rotating said cups from said upright orientation to said dumping orientation for selectively dispensing said wash additive; and, a plurality of chutes disposed below said cups when said cups are supported in said second position, said chutes extending from said tub for directing said dispensed wash additives into said tub sump.

11. In an automatic washer having a tub for receiving a clothes load to be washed and a water supply for delivering water to said tub, a dispenser for delivering a wash additive to said tub, comprising:

a cup for receiving said wash additive;

a tray pivotally supporting said cup, wherein said cup is movable between an upright orientation for holding said wash additive and a dumping orientation in which said wash additive in said cup is dispensed;

a housing slidably supporting said tray between a first position for adding said wash additive to said cup and a second position for dispensing said wash additive from said cup, said housing being disposed above said tub;

a lever positioned adjacent said cup when said tray is in said second position; and, means for selectively actuating said lever to engage said cup for moving said cup from said upright orientation to a dumping orientation in which said wash additive in said cup is dispensed.

12. The dispenser system according to claim 11 wherein said lever is positionable in a first position and a second position, said system further comprising:

a spring for biasing said lever toward said cup;

means for securing said lever against said spring bias; and means for selectively releasing said lever to move toward said cup such that said lever engages said cup and moves said cup from said upright orientation to said dumping orientation.

13. The dispenser system according to claim 12, further comprising:

a ramp extending from said tray for engaging said lever when said tray is moved from said second position to said first position such that said lever disengages said cup.

14. The dispenser system according to claim 11 further wherein:

said cup is pivotally supported by said tray in said second position such that said cup is urged by gravity to be oriented in said upright orientation; and, said lever selectively engages said cup such that said cup is urged by said lever to rotate toward said dumping orientation.

15. The dispenser system according to claim 11 further wherein:

said cup is pivotally supported by said tray in said second position such that said cup is urged by gravity to rotate toward said dumping orientation; and said lever supports said cup in said second position in said upright orientation and is selectively actuatable to release said cup to rotate toward said dumping orientation.

16. The dispenser system according to claim 11; further comprising:

an inlet hose interconnected with said water supply, said inlet hose being supported by said housing adjacent said cup wherein water flowing from said inlet hose flushes said wash additive from said cup when said cup is in said dumping orientation.

17. The dispenser system according to claim 11, wherein the automatic washer further includes an enclosure surrounding said tub, said enclosure having an access opening aligned with an opening in said tub, the dispenser system further wherein:

said tray has a handle portion, said tray is further slidably disposed adjacent said access opening such that when said tray is disposed in said first position, said cup is accessibly disposed within said access opening and when said tray is in said second position, said handle forms a portion of said access opening.

18. The dispenser system according to claim 11, wherein said tub includes a sump portion for receiving water supplied to said tub, said dispenser system further comprising:

a chute disposed below said cup when said cup is supported in said second position, said chute extending from said tub for directing said dispensed wash additive to said tub sump without contacting clothes load.

19. An automatic washer having a perforate, rotatable wash basket disposed within an imperforate tub, said washer including a wash additive dispenser system disposed above said tub for supplying wash additives into said tub, said tub comprising:

an enclosure surrounding said wash basket wherein said wash basket defines a horizontal axis, said enclosure including:

an access opening for accessing the interior of said tub wherein a clothes load may be loaded and unloaded through said access opening, a plurality of wash additive openings; and, a plurality of chutes formed about said plurality of opening and disposed below said dispenser system, wherein wash additive dispensed from said dispenser system is directed by said chutes to flow through said wash additive openings into the interior of said wash tub for subsequent application onto the clothes load without first contacting clothes load.

20. The automatic washer according to claim 19 wherein said chute comprises a plurality of walls extending upwardly from said tub above said wash additive opening, said walls forming a cup-like portion for channeling wash additive dispensed from said dispenser system into the interior of said tub.

21. The automatic washer according to claim 19 wherein a fill valve is provided for selectively controlling the flow of wash water into said tub, an inlet hose extending from said fill valve and including an outlet opening through which said wash water flows from the valve into said tub, said outlet opening is disposed above said wash additive opening, further wherein said chute directs said wash water, flowing out of said outlet opening, into said tub.

22. The automatic washer according to claim 19 wherein said tub includes a sump portion for receiving water supplied to said tub, said chute directing said dispensed wash additive to said sump portion from said wash additive dispenser system before contacting clothes load.

23. The automatic washer according to claim 19 wherein said wash additive dispenser system comprises:

a cup for receiving said wash additive;

a tray pivotally supporting said cup for movement between an upright orientation for holding said wash additive in said cup and a dumping orientation in which said wash additive is dispensed from said cup, said tray being slidable between a first position for adding said wash additive to said cup and a second position for dispensing said wash additive from said cup; and, means for selectively rotating said cup from said upright orientation to said dumping orientation for selectively dispensing said wash additive.

* * * * *